US006959650B2

(12) United States Patent
Greene et al.

(10) Patent No.: US 6,959,650 B2
(45) Date of Patent: Nov. 1, 2005

(54) CONVEYORABLE PLASTIC THERMOFORMED PALLET AND METHOD FOR MAKING PALLET

(75) Inventors: Cory D. Greene, Endeavor, WI (US); Mark A. Holmes, Portage, WI (US)

(73) Assignee: Wilbert, Inc., Broadview, IL (US)

( * ) Notice: Subject to any disclaimer, the term of this patent is extended or adjusted under 35 U.S.C. 154(b) by 350 days.

(21) Appl. No.: 10/315,328

(22) Filed: Dec. 10, 2002

(65) Prior Publication Data

US 2004/0107880 A1 Jun. 10, 2004

(51) Int. Cl.[7] ..... B65D 19/38
(52) U.S. Cl. ..... 108/57.25
(58) Field of Search ..... 108/57.25, 57.26, 108/57.27, 57.28, 901, 902, 51.11

(56) References Cited

U.S. PATENT DOCUMENTS

| | | | | |
|---|---|---|---|---|
| 3,696,761 A | | 10/1972 | Brown | |
| 3,702,100 A | | 11/1972 | Wharton | |
| 4,339,040 A | | 7/1982 | Peil et al. | |
| 4,606,278 A | * | 8/1986 | Shuert | 108/57.27 |
| 5,046,434 A | | 9/1991 | Breezer et al. | |
| 5,391,251 A | | 2/1995 | Shuert | |
| 5,401,347 A | | 3/1995 | Shuert | |
| 5,555,820 A | * | 9/1996 | Shuert | 108/57.25 |
| 5,606,921 A | | 3/1997 | Elder | |
| 5,676,064 A | | 10/1997 | Shuert | |
| 5,758,855 A | | 6/1998 | Jordan | |
| 5,794,544 A | * | 8/1998 | Shuert | 108/57.25 |
| 5,813,355 A | | 9/1998 | Brown et al. | |
| 5,855,691 A | | 1/1999 | Oram et al. | |
| 5,868,080 A | * | 2/1999 | Wyler et al. | 108/57.25 |
| 5,950,546 A | | 9/1999 | Brown et al. | |
| 6,018,927 A | | 2/2000 | Major | |
| 6,029,583 A | * | 2/2000 | LeTrudet | 108/57.25 |
| 6,186,078 B1 | | 2/2001 | Brown | |
| 2001/0029874 A1 | | 10/2001 | Muirhead | |

FOREIGN PATENT DOCUMENTS

| | | | |
|---|---|---|---|
| DE | 4323414 | | 5/1984 |
| DE | 3240593 | | 1/1995 |
| JP | 60090133 A | * | 5/1985 |

* cited by examiner

*Primary Examiner*—Jose V. Chen
(74) *Attorney, Agent, or Firm*—Blackwell Sanders Peper Martin LLP

(57) ABSTRACT

A Conveyorable Plastic Thermoformed Pallet, having a support member and support legs with outer walls, internal walls and inner walls, is utilized to transport product on a conveyor system. The Pallet is made using a twin-sheet thermoforming process that requires two molds for an upper sheet of thermoplastic material and a lower sheet of thermoplastic material. The upper sheet forms a top deck of the support member and the internal walls of the support legs. The lower sheet forms the underside of the support member, the inner walls of the support legs, and leg bottoms. Both sheets are fused to form the twin-sheet outer walls. The upper sheet also forms web strips which stabilize the walls of the support legs and prevent deflection of the walls.

15 Claims, 2 Drawing Sheets

CONVEYORABLE PLASTIC THERMOFORMED PALLET AND METHOD FOR MAKING PALLET

FIELD OF THE INVENTION

The present invention generally relates to pallets and, more particularly, to plastic pallets for use on conveyor systems.

BACKGROUND OF THE INVENTION

Pallets are commonly used to store and transport loads in many industries. Because plastic pallets are lighter and more durable than traditional wooden pallets, plastic pallets are replacing wooden pallets in many industries. Lighter plastic pallets are easier to move than wooden pallets and add less weight to a shipment of product, resulting in decreased transportation costs.

Besides the weight benefits of plastic pallets, wooden pallets have to be replaced more frequently than plastic pallets. Wooden pallets can become warped if exposed to moisture, making them difficult to use with a forklift or in a stack of load bearing pallets. Further, the nails necessary for constructing the wooden pallets can become loose, damaging product or causing personal injury.

Despite these benefits, some industries have not replaced wooden pallets with plastic pallets. Industries using conveyor systems, in particular, have not converted to plastic pallets. Wooden pallets used on conveyor systems have additional problems that could be solved by plastic pallets. Loose nails from a wooden pallet can get caught on the conveyor system, impeding product flow along the conveyor system and damaging the rollers of the conveyor system. The wooden pallets absorb liquid, making them heavier and creating cleanliness problems.

Despite these disadvantages, wooden pallets are still used with conveyorable systems because they offer more necessary advantages over current plastic pallets. Current plastic pallets are not as stiff as wooden pallets, resulting in dented plastic pallet legs, and dented pallet legs do not work well on the rollers of a conveyor system. Conventional twin-sheet plastic pallets have large openings in the deck surface, allowing product to fall into the openings, and attempts to decrease the size of the openings have required smaller support leg surfaces, which also do not work as well on conveyor rollers. Therefore, plastic pallets have not been used for applications requiring conveyor transportation of palleted goods.

SUMMARY OF THE INVENTION

A thermoformed pallet of this invention has a substantially planar support member with broad support legs having generally flat bottom surfaces. The support member has a top deck surface formed by an upper sheet of thermoplastic material and a lower surface formed by a lower sheet of thermoplastic material. The upper and lower thermoplastic sheets also form the support legs. The lower thermoplastic sheet forms the external walls of the support legs and the upper thermoplastic sheet forms the internal reinforcing walls of the support legs. The support legs extend across the width of the pallet and have one opening in the bottom surface of each leg that runs parallel to the direction of the pallet along a conveyor.

In a preferred embodiment, the top deck has openings where the upper sheet folds to form the internal walls of the support legs. The openings are partially filled with a web strip, which minimizes the volume of the opening and stabilizes the walls formed by the upper sheet.

It is an object of the present invention to provide an improved twin-sheet thermoformed plastic pallet with support legs for use with a conveyor system.

It is a further object of the present invention to provide an improved pallet with increased stiffness and durability.

BRIEF DESCRIPTION OF THE DRAWINGS

These and other inventive features, advantages, and objects will appear from the following Detailed Description when considered in connection with the accompanying drawings in which similar reference characters denote similar elements throughout the several views and wherein.

DETAILED DESCRIPTION

Figure 1:
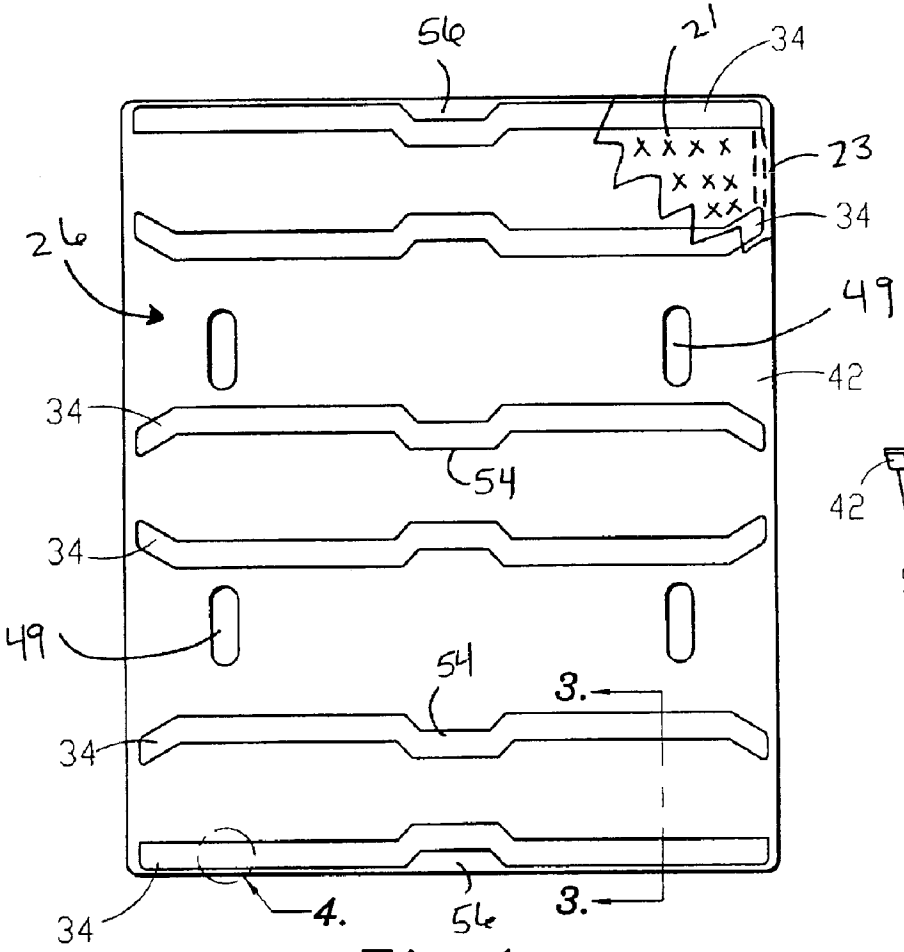
FIG. 1 is a top view of the pallet constructed in accordance with the present invention.

Referring to the drawings in greater detail, FIG. 1 shows a twin-sheet thermoformed plastic pallet 20 of this invention. The pallet 20 has a support member 22 with support legs 24 depending from the support member. The support member and support legs are formed from an upper sheet 26 of thermoplastic material and a lower sheet 28 of thermoplastic material. The upper sheet 26 forms a top deck surface 42 of the support member 22 and the lower sheet 28 forms an underside 44 of the support member. The lower sheet 28 forms inner walls 39 of the support legs and the upper sheet 26 forms internal walls 32 of the support legs. Portions of the upper and lower sheets are fused to form twin-sheet outer walls 37 for the support legs.

The pallet is formed by a dual mold thermoforming process, where a top mold (not shown) forms the upper sheet 26 and a bottom mold (not shown) forms the lower sheet 28. The upper and lower sheets are made from thermoplastic sheets of substantially uniform thickness.

As shown in FIG. 1, the top deck 42 is substantially flat, with openings 34 formed where the upper sheet 26 folds to form twin-sheet walls 37 and internal walls 32 of the support legs 24. In one preferred embodiment, the top deck has six leg openings, corresponding in position to the sides of the three support legs. Although there are several openings in the top deck, only one will be described for simplicity.

In a preferred embodiment, the opening 34 is a generally continuous, substantially linear opening extending across the width of the top deck 42. The opening 34 extends into the support member 22 approximately to the bottom of the support leg. The opening 34 is partially filled at intervals with a web strip 38 to stabilize the sides of the opening. In a preferred embodiment, the opening has four web strips evenly spaced apart along the opening, although the number and spacing could be varied. The web strip 38 is formed where the portions of the upper sheet 26 creating the opening 34 are positioned closer together. The sides of the opening 34 fuse together at these positions to form the web strip 38.

Figure 4:
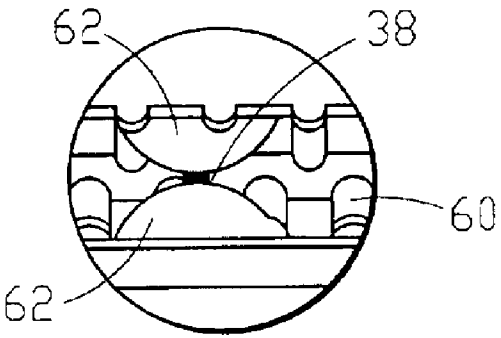
FIG. 4 is a close-up, top view of a web strip of FIG. 1.

As shown in FIG. 4, when viewed from above, the upper sheet 26 forms opposed half-circle bulges 62 in the folds of the opening 34 at the desired intervals, and the web strip 38 forms between these half-circle bulges 62. The bulges 62 are generally circular arcs facing each other in a hyperbolic-type arrangement. The web strip 38 prevents the sides of the opening 34 from bowing when the pallet is loaded with product, allowing the pallet to maintain its shape.

The opening also has stiffness ribs 60 positioned along the sides of the opening 34 and extending from the top deck 42 to the bottom 43 of the opening. As shown in FIG. 1, the opening 34 also has a jog 54 to effectively minimize the size of the opening, by breaking the continuously straight path of the opening. The jog 54 prevents product from falling or rolling into the opening 34 by effectively breaking the opening into three separate, smaller, linear sections. The jog is surrounded by top deck 42 space, even if the jog is located along the end of the pallet. The extra deck space 56 along the jogs located on the ends of the pallet, provides a place to rest product and keeps the sides of the top deck flush. In a preferred embodiment, the opening only has one jog located near the center of the opening, although the number of jogs could be increased if the pallet is to be loaded with very small items.

The support member 22 also has handles 49 formed into the support member. In a preferred embodiment, the support member has a total of four handles, with two handles placed on each side of the pallet and each handle positioned between two of the support legs. The handles 49 extend through the support member 22 and are generally oval shaped.

As shown in FIG. 1, the support member 22 has raised texturing on the top deck 42 in the form of cross hatches 21 and parallel hatches 23. The cross hatches are located along the center of the pallet, between the handles 49. The cross hatches help prevent product or loads from moving on the support member. The parallel hatches 23 are located on the sides of the pallet and have points that are capable of piercing cardboard. The parallel hatches 23 help keep cardboard boxes positioned on the pallet during loading and transportation.

Figure 2:
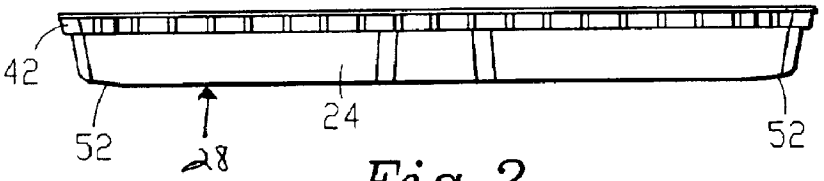
FIG. 2 is a side view of the pallet of FIG. 1.

As shown in FIG. 2, the pallet 20 has support legs 24 depending from the support member 22. In a preferred embodiment, the pallet has three support legs, with one leg under the center of the pallet and the other two legs placed near the ends of the pallet. The legs 24 are spaced far enough apart to allow the tines of a forklift to slide between the legs for transporting the pallet. The legs are generally flat on the bottom 30, with a substantially continuous, inverted V-shaped opening 41 at the center of each leg 24. The tip 43 of the inverted V is flattened and has double wall thickness. In a preferred embodiment, the opening 41 is filled at two places, creating three separate, but aligned, openings. These three openings are uniform in shape and size and equally positioned on the leg bottom 30. The opening 41 does not extend to the end of the leg bottom 30. The ends of the leg bottoms are flat, with no openings. The legs 24 are tapered inwards from the support member 22 to the bottom of the leg. The legs are inwardly beveled on the ends to guide forklift tines into the space between the legs.

Figure 3:
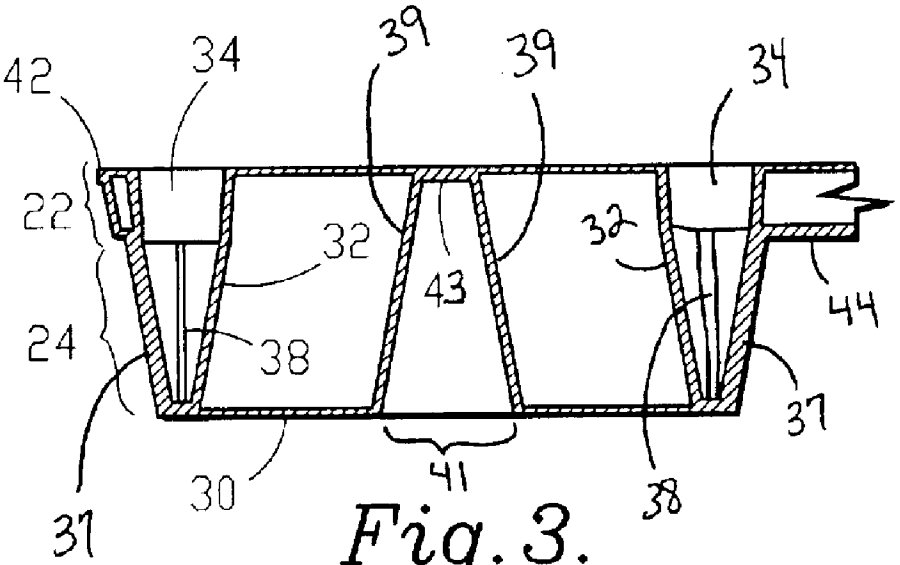
FIG. 3 is a cross-sectional view of a support leg of FIG. 1.

As shown in FIG. 3, the support legs 24 include twin-sheet outer walls 37, internal walls 32 formed by the upper sheet 26, inner walls 39 formed by the lower sheet 28, and leg bottoms 30 formed by the lower sheet with a section of twin-sheet construction near the outer walls 37. The outer walls 37 of the support legs 24 are formed by the upper and lower sheets, which are fused together during the thermoforming process to form twin-sheet walls. The twin-sheet walls are thicker than the internal 32 or inner walls 39 and therefore have greater stiffness and durability. The support legs have twin-sheet walls at the sides of the legs, where the pallet would come into contact with forklift tines, conveyor stops, or other structures.

The internal walls 32 of the support legs 24 are also the sides of the openings 34 formed by the upper sheet 26. The internal walls 32 serve to reinforce the support legs, helping them maintain their structure even when supporting a product load. The internal walls 32 serve to decrease leg wall deflection common with conventional twin-sheet pallets.

The inner walls 39 formed by the lower sheet 28 also form the inverted V-shaped opening 41 in the center of the support leg 24. Each inner wall 39 is parallel to the internal wall 32 located on that same side of the opening 41, as shown in FIG. 3. The inner walls are not parallel to each other, just as the internal walls are not parallel to each other. These inner walls 39 provide greater stiffness in the support leg and also reduce deflection of the walls, which is common with conventional plastic pallets. With conventional pallets, the walls of the support legs bow under the weight of product loads, causing the bottom 30 of the leg to bow as well, losing contact with the surface under the pallet. The pallet deforms over time, creating a leg bottom that only contacts the surface it is placed on at the edges of the leg bottom. A pallet deformed in this way does not move smoothly across rollers The lower sheet 28 also forms the leg bottoms 30, which are generally flat. The leg bottoms 30 have a gap created by the inverted V-shape opening 41 that extends substantially the length of the leg. The opening 41 does not extend to the ends of the leg bottom 30, where the leg is flat with no gaps or openings. The leg bottoms of this invention perform better on the rollers of a conveyor system than traditional pallets because they only have openings running parallel to the direction of the pallet along the rollers. The openings 41 do not provide an edge to get caught on the rollers, which can impede product flow along the conveyor system.

As shown in FIG. 4, the support legs have a cantilever 52 on the end of each leg to allow the pallet to move smoothly from one roller to the next on a conveyor system. The ends of the support legs are raised slightly to form the cantilever 52. The cantilever provides a smooth and gradually sloping surface to contact the rollers. The elevation of the cantilever is enough to maintain a sloped end even when the pallet is carrying a heavy load that forces the ends of the pallet legs downward.

The pallet is manufactured using a twin-sheet thermoforming process where two sheets of thermoplastic material, the upper and lower sheets, are thermoformed together into the shape of the pallet by using two vacuum molds, a top and a bottom mold. The upper sheet is heated until it is malleable and then mounted on the top mold, where the vacuum ports of the top mold draw the heated thermoplastic sheet against the mold, conforming to the shape of the mold. The same process is repeated with the lower sheet and the bottom mold. Once the two sheets have conformed to the molds, the sheets are brought together to form the pallet and the molds are separated from the upper and lower sheets.

The top mold has two ribs for each support leg that extend substantially across the width of the pallet. In a preferred embodiment, the mold ribs have four equally spaced recesses that form the half-circle bulges of the web strips. The number and spacing of recesses can vary depending on the size and structural needs of the pallet. The mold ribs are narrowed at this point, bringing the two sides of the upper sheet into close position when forming the pallet. The recesses in the mold ribs also create a small opening between the half-circle bulges, where the two sides of the upper sheet folded around the mold rib are not separated by the rib. As the upper sheet is drawn across the top mold, the proximity and temperature of the half-circle bulges across from each other creates the web strip 38. The two sides of the upper sheet fuse together at that point when the mold no longer separates them.

The bottom mold has mold ribs running along the center of each support leg to form the inverted V-shaped opening in the legs. These ribs are uniform and extend the length of the legs.

When both sheets have been formed to the molds, and while they are both still heated, the molds are positioned together to form the pallet. The sheets melt together where the molds match up in desired positions to create the support member and the support legs.

Thus, a conveyorable plastic thermoformed pallet and method for making pallet is disclosed which utilizes internal walls, inner walls, and web strips to prevent deflection of the support walls in the support legs of the pallet thereby enhancing the stiffness and durability of the pallet and the suitability of the pallet for use on a conveyor system. While preferred embodiments and particular applications of this invention have been shown and described, it is apparent to those skilled in the art that many other modifications and applications of this invention are possible without departing from the inventive concepts herein. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. A twin-sheet thermoformed pallet comprising:

a substantially planar support member formed from an upper sheet of thermoplastic material and a lower sheet of thermoplastic material, the upper sheet forming a top surface of the support member and the lower sheet forming a bottom surface of the support member;

at least two support legs depending from the support member, the external structure of each leg formed from the lower sheet and the internal structures of each leg formed from the upper sheet, the lower sheet forming the legs extending across the width of the pallet with a substantially flat leg bottom;

an opening in the top surface of the support member formed where the upper sheet folds to form the internal structures of the support legs; and a plastic webbing in the opening wherein the webbing connects the sides of the opening and partially fills the opening.

2. The pallet according to claim 1 wherein the upper sheet and lower sheet fuse to form a lip around the perimeter of the support member.

3. The pallet according to claim 1 wherein the opening extends across the width of the top surface.

4. The pallet according to claim 3, wherein there are two or more of the opening.

5. The pallet according to claim 1 wherein the opening is terraced to decrease the size of the opening.

6. The pallet according to claim 1 wherein the pallet comprises three support legs.

7. The pallet according to claim 6 wherein the pallet comprises support legs with a cantilever on the ends of the legs.

8. The pallet according to claim 7 wherein the pallet comprises support legs with a cantilever raised enough to keep the ends of the legs raised even when the pallet support a heavy product load.

9. The pallet according to claim 6 wherein the legs are sufficiently spaced apart to allow a forklift tine to pass between the legs.

10. The pallet according to claim 6 wherein the legs are tapered inward from the support member towards the bottom of the legs.

11. The pallet according to claim 6 wherein two of the support legs are reinforced to withstand impact with conveyor stops.

12. A twin-sheet thermoformed plastic pallet comprising:

a substantially planar support member formed by an upper and lower thermoplastic sheet;

the lower sheet forming the underside of the support member and the external walls of at least two support legs extending downward from the support member;

the support legs including reinforced impact zones on the sides of the legs and a cantilever on the ends of the legs;

the upper sheet forming the top surface of the planar support member, internal walls extending into the support legs, and openings in the top surface formed where the upper sheet folds to create the internal leg walls; and a web strip positioned inside the opening formed by the upper sheet, the web strip partially filling the opening and fusing the sides of the opening together.

13. A method for forming a twin-sheet plastic pallet comprising:

forming a lower plastic sheet by heating the sheet to a heated, flowable state and drawing the heated lower sheet against a bottom mold by vacuum, where the molded lower sheet forms an underside for the substantially planar surface of the upper sheet, and external walls of support legs extending from the bottom of the planar surface;

forming an upper plastic sheet by heating the sheet to a heated, flowable state and drawing the heated upper sheet against a top mold by vacuum, where the molded upper sheet forms a substantially planar upper surface and internal walls for pallet legs, formation of the internal walls also Conning openings in the upper surface;

while the upper and lower sheets are still heated, bringing the upper and lower sheets together to fuse the upper and bottom portions of the substantially planar surfaces together, and to fuse the internal walls formed by the upper sheet with the external walls of the support legs formed by the lower sheet;

forming a web strip between the internal walls and the external walls of the support legs to stabilize the walls and minimize the openings in the upper surface.

14. The method according to claim 13, wherein forming the pallet comprises cooling the upper and lower sheets after positioning the web strip to harden the plastic sheets.

15. The method according to claim 13, wherein forming the pallet comprises fusing the portions of the upper and lower sheets that form the external most walls of the support legs to form a twin-sheet wall for the external wall of the support legs.

* * * * *